US010885926B2

(12) United States Patent
Gao

(10) Patent No.: US 10,885,926 B2
(45) **Date of Patent: *Jan. 5, 2021**

(54) CLASSIFICATION BETWEEN TIME-DOMAIN CODING AND FREQUENCY DOMAIN CODING FOR HIGH BIT RATES

(71) Applicant: Huawei Technologies Co., Ltd., Shenzhen (CN)

(72) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/749,755

(22) Filed: Jan. 22, 2020

(65) Prior Publication Data

US 2020/0234724 A1 Jul. 23, 2020

Related U.S. Application Data

(63) Continuation of application No. 15/784,802, filed on Oct. 16, 2017, now Pat. No. 10,586,547, which is a continuation of application No. 15/592,573, filed on May 11, 2017, now Pat. No. 9,837,092, which is a continuation of application No. 14/511,943, filed on Oct. 10, 2014, now Pat. No. 9,685,166.

(Continued)

(51) Int. Cl.

| | |
|---|---|
| ***G10L 19/125*** | (2013.01) |
| ***G10L 19/22*** | (2013.01) |
| ***G10L 19/002*** | (2013.01) |
| ***G10L 19/00*** | (2013.01) |

(52) U.S. Cl.

CPC ..... *G10L 19/125* (2013.01); *G10L 19/002* (2013.01); *G10L 19/22* (2013.01); *G10L 2019/0002* (2013.01); *G10L 2019/0011* (2013.01); *G10L 2019/0016* (2013.01)

(58) Field of Classification Search

None

See application file for complete search history.

(56) References Cited

U.S. PATENT DOCUMENTS 5,579,437 A 11/1996 Fette et al.
2005/0097217 A1* 5/2005 Val ..... H04L 41/0896 709/233

(Continued)

FOREIGN PATENT DOCUMENTS

CN 1437747 A 8/2003
CN 102576534 A 7/2012

(Continued)

OTHER PUBLICATIONS

International Search Report of Patent Coorperation Treaty (PCT), International Application No. PCT/CN/2015/084931, Applicant Huawei Technologies Co., Ltd, dated Oct. 30, 2015, 11 pages.

(Continued)

*Primary Examiner* — Kevin Ky
(74) *Attorney, Agent, or Firm* — Slater Matsil, LLP

(57) ABSTRACT

A method for processing speech signals prior to encoding a digital signal comprising audio data includes selecting frequency domain coding or time domain coding based on a coding bit rate to be used for coding the digital signal and a short pitch lag detection of the digital signal.

20 Claims, 10 Drawing Sheets

Related U.S. Application Data

(60) Provisional application No. 62/029,437, filed on Jul. 26, 2014.

(56) References Cited

U.S. PATENT DOCUMENTS

| | | | | |
|---|---|---|---|---|
| 2007/0106502 | A1* | 5/2007 | Kim | G10L 19/12 704/207 |
| 2007/0233470 | A1 | 10/2007 | Goto et al. | |
| 2010/0063806 | A1* | 3/2010 | Gao | G10L 19/022 704/207 |
| 2010/0070269 | A1 | 3/2010 | Gao | |
| 2010/0070270 | A1* | 3/2010 | Gao | G10L 19/26 704/207 |
| 2012/0185241 | A1 | 7/2012 | Miyasaka et al. | |
| 2013/0096912 | A1 | 4/2013 | Resch et al. | |
| 2013/0166287 | A1 | 6/2013 | Gao | |
| 2013/0166288 | A1* | 6/2013 | Gao | G10L 25/21 704/207 |
| 2014/0081629 | A1 | 3/2014 | Gao | |
| 2015/0221318 | A1 | 8/2015 | Gao | |
| 2017/0309283 | A1 | 10/2017 | Rettelbach et al. | |

FOREIGN PATENT DOCUMENTS

| | | | |
|---|---|---|---|
| CN | 101283255 | B | 12/2013 |
| CN | 103915100 | A | 7/2014 |
| EP | 1259957 | B1 | 9/2006 |
| EP | 1886294 | B1 | 12/2009 |
| JP | H06337699 | A | 12/1994 |
| JP | 2011075936 | A | 4/2011 |
| RU | 2483366 | C2 | 5/2013 |
| WO | 2006022308 | A1 | 3/2006 |
| WO | 2008114925 | A1 | 9/2008 |
| WO | 2010008185 | A2 | 1/2010 |
| WO | 2013096900 | A1 | 6/2013 |

OTHER PUBLICATIONS

Kabal P., et al, Synthesis Filter Optimization and Coding: Applications toCELP (speech analysis) proceedings of EEE ICASSP 88, Apr. 14, 1988, pp. 147-150.

* cited by examiner

CLASSIFICATION BETWEEN TIME-DOMAIN CODING AND FREQUENCY DOMAIN CODING FOR HIGH BIT RATES

CROSS-REFERENCE TO RELATED APPLICATIONS

This application is a continuation of U.S. patent application Ser. No. 15/784,802, filed on Oct. 16, 2017, which is a continuation of U.S. patent application Ser. No. 15/592,573, filed on May 11, 2017, now U.S. Pat. No. 9,837,092, which is a continuation of U.S. patent application Ser. No. 14/511,943, filed on Oct. 10, 2014, now U.S. Pat. No. 9,685,166, which claims priority to U.S. Provisional Patent Application No. 62/029,437, filed on Jul. 26, 2014. All of the aforementioned patent applications are hereby incorporated by reference in their entireties.

TECHNICAL FIELD

The present invention is generally in the field of signal coding. In particular, the present invention is in the field of improving classification between time-domain coding and frequency domain coding.

BACKGROUND

Speech coding refers to a process that reduces the bit rate of a speech file. Speech coding is an application of data compression of digital audio signals containing speech. Speech coding uses speech-specific parameter estimation using audio signal processing techniques to model the speech signal, combined with generic data compression algorithms to represent the resulting modeled parameters in a compact bitstream. The objective of speech coding is to achieve savings in the required memory storage space, transmission bandwidth and transmission power by reducing the number of bits per sample such that the decoded (decompressed) speech is perceptually indistinguishable from the original speech.

However, speech coders are lossy coders, i.e., the decoded signal is different from the original. Therefore, one of the goals in speech coding is to minimize the distortion (or perceptible loss) at a given bit rate, or minimize the bit rate to reach a given distortion.

Speech coding differs from other forms of audio coding in that speech is a much simpler signal than most other audio signals, and a lot more statistical information is available about the properties of speech. As a result, some auditory information which is relevant in audio coding can be unnecessary in the speech coding context. In speech coding, the most important criterion is preservation of intelligibility and "pleasantness" of speech, with a constrained amount of transmitted data.

The intelligibility of speech includes, besides the actual literal content, also speaker identity, emotions, intonation, timbre etc. that are all important for perfect intelligibility. The more abstract concept of pleasantness of degraded speech is a different property than intelligibility, since it is possible that degraded speech is completely intelligible, but subjectively annoying to the listener.

Traditionally, all parametric speech coding methods make use of the redundancy inherent in the speech signal to reduce the amount of information that must be sent and to estimate the parameters of speech samples of a signal at short intervals. This redundancy primarily arises from the repetition of speech wave shapes at a quasi-periodic rate, and the slow changing spectral envelop of speech signal.

The redundancy of speech wave forms may be considered with respect to several different types of speech signal, such as voiced and unvoiced speech signals. Voiced sounds, e.g., 'a', 'b', are essentially due to vibrations of the vocal cords, and are oscillatory. Therefore, over short periods of time, they are well modeled by sums of periodic signals such as sinusoids. In other words, for voiced speech, the speech signal is essentially periodic. However, this periodicity may be variable over the duration of a speech segment and the shape of the periodic wave usually changes gradually from segment to segment. A low bit rate speech coding could greatly benefit from exploring such periodicity. A time domain speech coding could greatly benefit from exploring such periodicity. The voiced speech period is also called pitch, and pitch prediction is often named Long-Term Prediction (LTP). In contrast, unvoiced sounds such as 's', 'sh', are more noise-like. This is because unvoiced speech signal is more like a random noise and has a smaller amount of predictability.

In either case, parametric coding may be used to reduce the redundancy of the speech segments by separating the excitation component of speech signal from the spectral envelop component, which changes at slower rate. The slowly changing spectral envelope component can be represented by Linear Prediction Coding (LPC) also called Short-Term Prediction (STP). A low bit rate speech coding could also benefit a lot from exploring such a Short-Term Prediction. The coding advantage arises from the slow rate at which the parameters change. Yet, it is rare for the parameters to be significantly different from the values held within a few milliseconds.

In more recent well-known standards such as G.723.1, G.729, G.718, Enhanced Full Rate (EFR), Selectable Mode Vocoder (SMV), Adaptive Multi-Rate (AMR), Variable-Rate Multimode Wideband (VMR-WB), or Adaptive Multi-Rate Wideband (AMR-WB), Code Excited Linear Prediction Technique ("CELP") has been adopted. CELP is commonly understood as a technical combination of Coded Excitation, Long-Term Prediction and Short-Term Prediction. CELP is mainly used to encode speech signal by benefiting from specific human voice characteristics or human vocal voice production model. CELP Speech Coding is a very popular algorithm principle in speech compression area although the details of CELP for different codecs could be significantly different. Owing to its popularity, CELP algorithm has been used in various ITU-T, MPEG, 3GPP, and 3GPP2 standards. Variants of CELP include algebraic CELP, relaxed CELP, low-delay CELP and vector sum excited linear prediction, and others. CELP is a generic term for a class of algorithms and not for a particular codec.

The CELP algorithm is based on four main ideas. First, a source-filter model of speech production through linear prediction (LP) is used. The source-filter model of speech production models speech as a combination of a sound source, such as the vocal cords, and a linear acoustic filter, the vocal tract (and radiation characteristic). In implementation of the source-filter model of speech production, the sound source, or excitation signal, is often modelled as a periodic impulse train, for voiced speech, or white noise for unvoiced speech. Second, an adaptive and a fixed codebook is used as the input (excitation) of the LP model. Third, a search is performed in closed-loop in a "perceptually weighted domain." Fourth, vector quantization (VQ) is applied.

SUMMARY

In accordance with an embodiment of the present invention, a method for processing speech signals prior to encoding a digital signal comprising audio data includes selecting frequency domain coding or time domain coding based on a coding bit rate to be used for coding the digital signal and a short pitch lag detection of the digital signal.

In accordance with an alternative embodiment of the present invention, a method for processing speech signals prior to encoding a digital signal comprising audio data comprises selecting frequency domain coding for coding the digital signal when a coding bit rate is higher than an upper bit rate limit. Alternatively, the method selects time domain coding for coding the digital signal when the coding bit rate is lower than a lower bit rate limit. The digital signal comprises a short pitch signal for which the pitch lag is shorter than a pitch lag limit.

In accordance with an alternative embodiment of the present invention, a method for processing speech signals prior to encoding comprises selecting time domain coding for coding a digital signal comprising audio data when the digital signal does not comprise short pitch signal and the digital signal is classified as unvoiced speech or normal speech. The method further comprises selecting frequency domain coding for coding the digital signal when coding bit rate is intermediate between a lower bit rate limit and an upper bit rate limit. The digital signal comprises short pitch signal and voicing periodicity is low. The method further includes selecting time domain coding for coding the digital signal when coding bit rate is intermediate and the digital signal comprises short pitch signal and a voicing periodicity is very strong.

In accordance with an alternative embodiment of the present invention, an apparatus for processing speech signals prior to encoding a digital signal comprising audio data comprises a coding selector configured to select frequency domain coding or time domain coding based on a coding bit rate to be used for coding the digital signal and a short pitch lag detection of the digital signal.

BRIEF DESCRIPTION OF THE DRAWINGS

For a more complete understanding of the present invention, and the advantages thereof, reference is now made to the following descriptions taken in conjunction with the accompanying drawings, in which:

FIGS. 9A and 9B illustrate the schematic of a typical frequency domain perceptual codec, wherein FIG. 9A illustrates a frequency domain encoder whereas FIG. 9B illustrates a frequency domain decoder;

DETAILED DESCRIPTION OF ILLUSTRATIVE EMBODIMENTS

In modern audio/speech digital signal communication system, a digital signal is compressed at an encoder, and the compressed information or bit-stream can be packetized and sent to a decoder frame by frame through a communication channel. The decoder receives and decodes the compressed information to obtain the audio/speech digital signal.

In modern audio/speech digital signal communication system, a digital signal is compressed at an encoder, and the compressed information or bitstream can be packetized and sent to a decoder frame by frame through a communication channel. The system of both encoder and decoder together is called codec. Speech/audio compression may be used to reduce the number of bits that represent speech/audio signal thereby reducing the bandwidth and/or bit rate needed for transmission. In general, a higher bit rate will result in higher audio quality, while a lower bit rate will result in lower audio quality.

Figure 1:
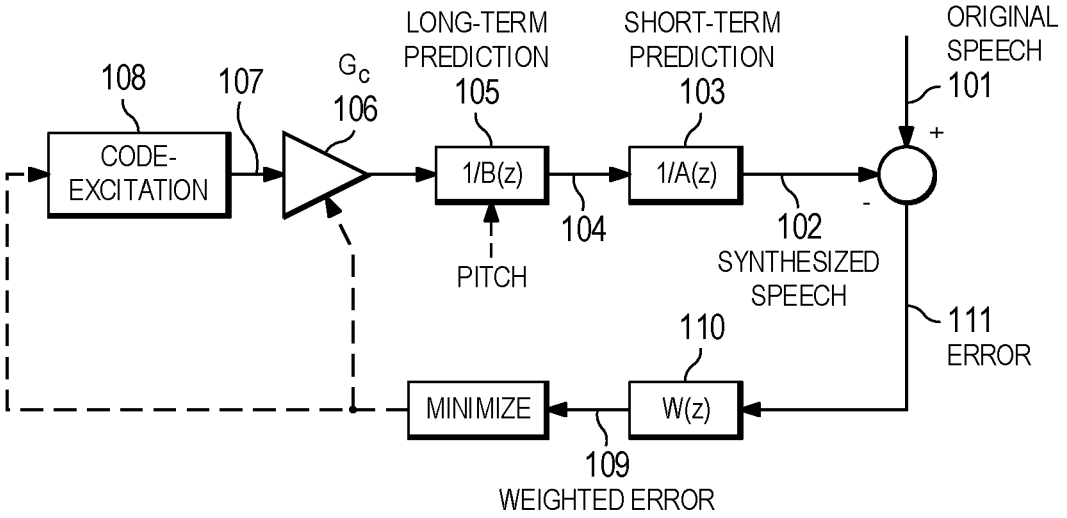
FIG. 1 illustrates operations performed during encoding of an original speech using a conventional CELP encoder.

FIG. 1 illustrates operations performed during encoding of an original speech using a conventional CELP encoder.

FIG. 1 illustrates a conventional initial CELP encoder where a weighted error 109 between a synthesized speech 102 and an original speech 101 is minimized often by using an analysis-by-synthesis approach, which means that the encoding (analysis) is performed by perceptually optimizing the decoded (synthesis) signal in a closed loop.

The basic principle that all speech coders exploit is the fact that speech signals are highly correlated waveforms. As an illustration, speech can be represented using an autoregressive (AR) model as in Equation (1) below.

$$X_n = \sum_{i=1}^{P} a_i X_{n-1} + e_n \tag{i}$$

In Equation (11), each sample is represented as a linear combination of the previous P samples plus a white noise. The weighting coefficients $a_1, a_2, \ldots a_P$, are called Linear Prediction Coefficients (LPCs). For each frame, the weighting coefficients $a_1, a_2, \ldots a_P$, are chosen so that the spectrum of $\{X_1, X_2, \ldots, X_N\}$, generated using the above model, closely matches the spectrum of the input speech frame.

Alternatively, speech signals may also be represented by a combination of a harmonic model and noise model. The harmonic part of the model is effectively a Fourier series representation of the periodic component of the signal. In general, for voiced signals, the harmonic plus noise model of speech is composed of a mixture of both harmonics and noise. The proportion of harmonic and noise in a voiced speech depends on a number of factors including the speaker characteristics (e.g., to what extent a speaker's voice is normal or breathy); the speech segment character (e.g. to what extent a speech segment is periodic) and on the frequency. The higher frequencies of voiced speech have a higher proportion of noise-like components.

Linear prediction model and harmonic noise model are the two main methods for modelling and coding of speech signals. Linear prediction model is particularly good at modelling the spectral envelop of speech whereas harmonic noise model is good at modelling the fine structure of speech. The two methods may be combined to take advantage of their relative strengths.

As indicated previously, before CELP coding, the input signal to the handset's microphone is filtered and sampled, for example, at a rate of 8000 samples per second. Each sample is then quantized, for example, with 13 bit per sample. The sampled speech is segmented into segments or frames of 20 ms (e.g., in this case 160 samples).

The speech signal is analyzed and its LP model, excitation signals and pitch are extracted. The LP model represents the spectral envelop of speech. It is converted to a set of line spectral frequencies (LSF) coefficients, which is an alternative representation of linear prediction parameters, because LSF coefficients have good quantization properties. The LSF coefficients can be scalar quantized or more efficiently they can be vector quantized using previously trained LSF vector codebooks.

The code-excitation includes a codebook comprising codevectors, which have components that are all independently chosen so that each codevector may have an approximately 'white' spectrum. For each subframe of input speech, each of the codevectors is filtered through the short-term linear prediction filter 103 and the long-term prediction filter 105, and the output is compared to the speech samples. At each subframe, the codevector whose output best matches the input speech (minimized error) is chosen to represent that subframe.

The coded excitation 108 normally comprises pulse-like signal or noise-like signal, which are mathematically constructed or saved in a codebook. The codebook is available to both the encoder and the receiving decoder. The coded excitation 108, which may be a stochastic or fixed codebook, may be a vector quantization dictionary that is (implicitly or explicitly) hard-coded into the codec. Such a fixed codebook may be an algebraic code-excited linear prediction or be stored explicitly.

A codevector from the codebook is scaled by an appropriate gain to make the energy equal to the energy of the input speech. Accordingly, the output of the coded excitation 108 is scaled by a gain $G_c$ 107 before going through the linear filters.

The short-term linear prediction filter 103 shapes the 'white' spectrum of the codevector to resemble the spectrum of the input speech. Equivalently, in time-domain, the short-term linear prediction filter 103 incorporates short-term correlations (correlation with previous samples) in the white sequence. The filter that shapes the excitation has an all-pole model of the form 1/A(z) (short-term linear prediction filter 103), where A(z) is called the prediction filter and may be obtained using linear prediction (e.g., Levinson-Durbin algorithm). In one or more embodiments, an all-pole filter may be used because it is a good representation of the human vocal tract and because it is easy to compute.

The short-term linear prediction filter 103 is obtained by analyzing the original signal 101 and represented by a set of coefficients:

$$A(z) = \sum_{i=1}^{P} 1 + a_i \cdot z^{-i},\ i = 1, 2, \ldots, P \tag{2}$$

As previously described, regions of voiced speech exhibit long term periodicity. This period, known as pitch, is introduced into the synthesized spectrum by the pitch filter 1/(B(z)). The output of the long-term prediction filter 105 depends on pitch and pitch gain. In one or more embodiments, the pitch may be estimated from the original signal, residual signal, or weighted original signal. In one embodiment, the long-term prediction function (B(z)) may be expressed using Equation (3) as follows.

$$B(z)=1-G_p z^{-Pitch} \tag{3}$$

The weighting filter no is related to the above short-term prediction filter. One of the typical weighting filters may be represented as described in Equation (4).

$$W(z) = \frac{A(z/\alpha)}{1-\beta \cdot z^{-1}} \tag{4}$$

where $\beta<\alpha$, $0<\beta<1$, $0<\alpha\leq 1$.

In another embodiment, the weighting filter W(z) may be derived from the LPC filter by the use of bandwidth expansion as illustrated in one embodiment in Equation (5) below.

$$W(z) = \frac{A(z/\gamma 1)}{A(z/\gamma 2)}, \tag{5}$$

In Equation (5), $\gamma 1>\gamma 2$, which are the factors with which the poles are moved towards the origin.

Accordingly, for every frame of speech, the LPCs and pitch are computed and the filters are updated. For every subframe of speech, the codevector that produces the 'best' filtered output is chosen to represent the subframe. The corresponding quantized value of gain has to be transmitted to the decoder for proper decoding. The LPCs and the pitch values also have to be quantized and sent every frame for reconstructing the filters at the decoder. Accordingly, the coded excitation index, quantized gain index, quantized long-term prediction parameter index, and quantized short-term prediction parameter index are transmitted to the decoder.

Figure 2:
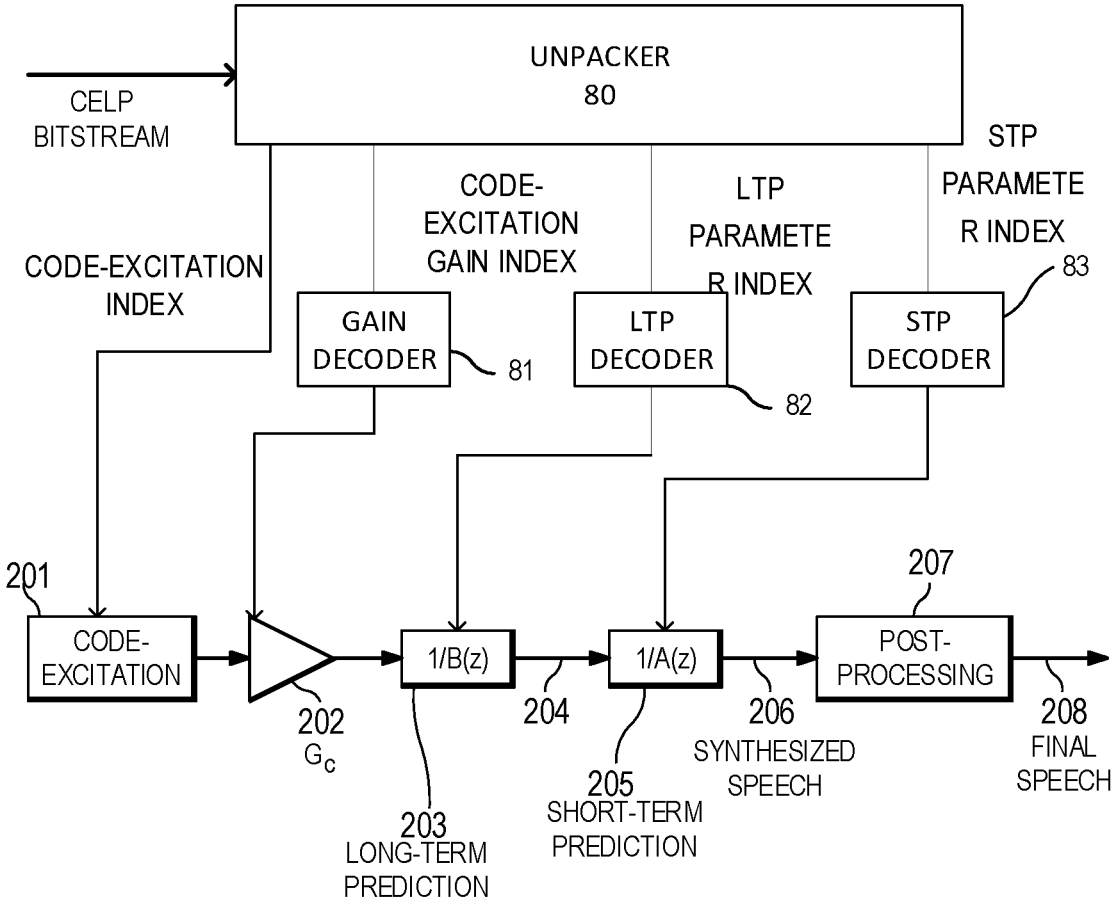
FIG. 2 illustrates operations performed during decoding of an original speech using a CELP decoder.

FIG. 2 illustrates operations performed during decoding of an original speech using a CELP decoder.

The speech signal is reconstructed at the decoder by passing the received codevectors through the corresponding filters. Consequently, every block except post-processing has the same definition as described in the encoder of FIG. 1.

The coded CELP bitstream is received and unpacked 80 at a receiving device. For each subframe received, the received coded excitation index, quantized gain index, quantized long-term prediction parameter index, and quantized short-term prediction parameter index, are used to find the corresponding parameters using corresponding decoders, for example, gain decoder 81, long-term prediction decoder 82, and short-term prediction decoder 83. For example, the positions and amplitude signs of the excitation pulses and the algebraic code vector of the code-excitation 402 may be determined from the received coded excitation index.

Referring to FIG. 2, the decoder is a combination of several blocks which includes coded excitation 201, long-term prediction 203, short-term prediction 205. The initial decoder further includes post-processing block 207 after a synthesized speech 206. The post-processing may further comprise short-term post-processing and long-term post-processing.

Figure 3:
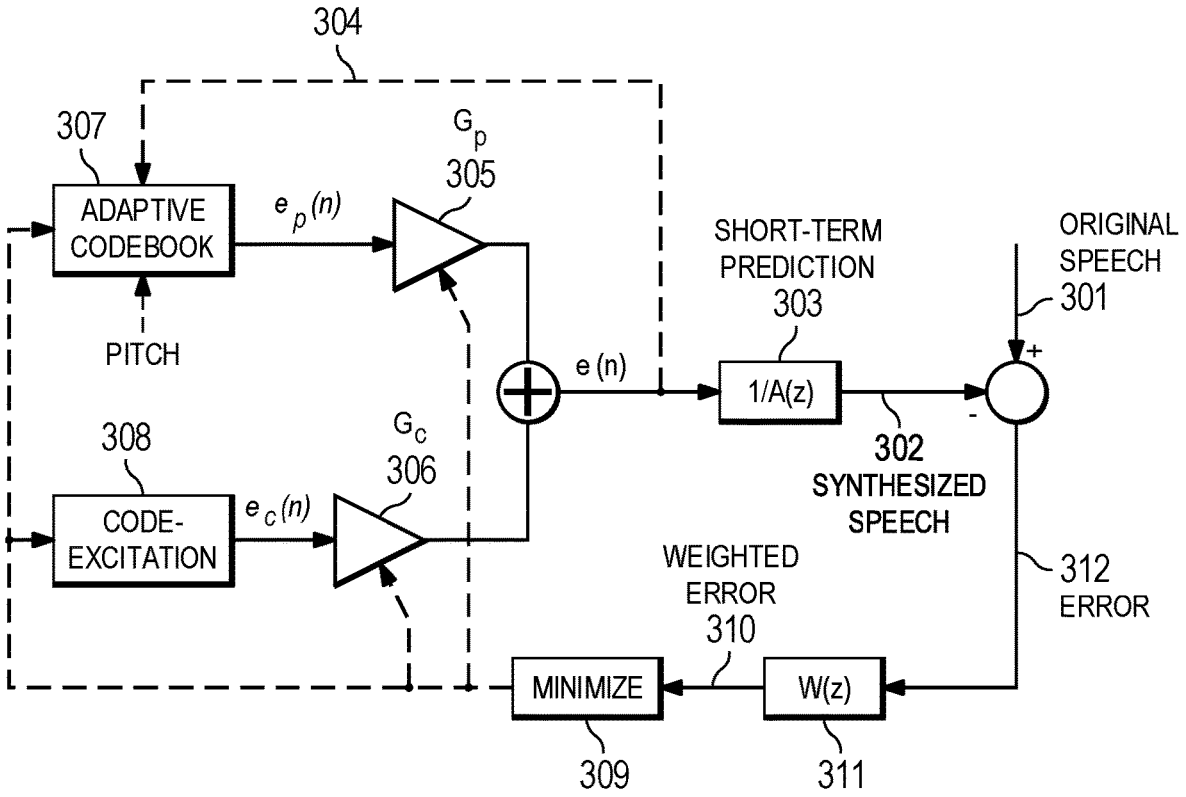
FIG. 3 illustrates a conventional CELP encoder.

FIG. 3 illustrates a conventional CELP encoder.

FIG. 3 illustrates a basic CELP encoder using an additional adaptive codebook for improving long-term linear prediction. The excitation is produced by summing the contributions from an adaptive codebook 307 and a code excitation 308, which may be a stochastic or fixed codebook as described previously. The entries in the adaptive codebook comprise delayed versions of the excitation. This makes it possible to efficiently code periodic signals such as voiced sounds.

Referring to FIG. 3, an adaptive codebook 307 comprises a past synthesized excitation 304 or repeating past excitation pitch cycle at pitch period. Pitch lag may be encoded in integer value when it is large or long. Pitch lag is often encoded in more precise fractional value when it is small or short. The periodic information of pitch is employed to generate the adaptive component of the excitation. This excitation component is then scaled by a gain $G_p$ 305 (also called pitch gain).

Long-Term Prediction plays a very important role for voiced speech coding because voiced speech has strong periodicity. The adjacent pitch cycles of voiced speech are similar to each other, which means mathematically the pitch gain $G_p$ in the following excitation express is high or close to 1. The resulting excitation may be expressed as in Equation (6) as combination of the individual excitations.

$$e(n)=G_p \cdot e_p(n)+G_c \cdot e_c(n) \tag{6}$$

where, $e_p(n)$ is one subframe of sample series indexed by n, coming from the adaptive codebook 307 which comprises the past excitation 304 through the feedback loop (FIG. 3). $e_p(n)$ may be adaptively low-pass filtered as the low frequency area is often more periodic or more harmonic than high frequency area. $e_c(n)$ is from the coded excitation codebook 308 (also called fixed codebook) which is a current excitation contribution. Further, $e_c(n)$ may also be enhanced such as by using high pass filtering enhancement, pitch enhancement, dispersion enhancement, formant enhancement, and others.

For voiced speech, the contribution of $e_p(n)$ from the adaptive codebook 307 may be dominant and the pitch gain $G_p$ 305 is around a value of 1. The excitation is usually updated for each subframe. Typical frame size is 20 milliseconds and typical subframe size is 5 milliseconds.

As described in FIG. 1, the fixed coded excitation 308 is scaled by a gain $G_c$ 306 before going through the linear filters. The two scaled excitation components from the fixed coded excitation 108 and the adaptive codebook 307 are added together before filtering through the short-term linear prediction filter 303. The two gains ($G_p$ and $G_c$) are quantized and transmitted to a decoder. Accordingly, the coded excitation index, adaptive codebook index, quantized gain indices, and quantized short-term prediction parameter index are transmitted to the receiving audio device.

Figure 4:
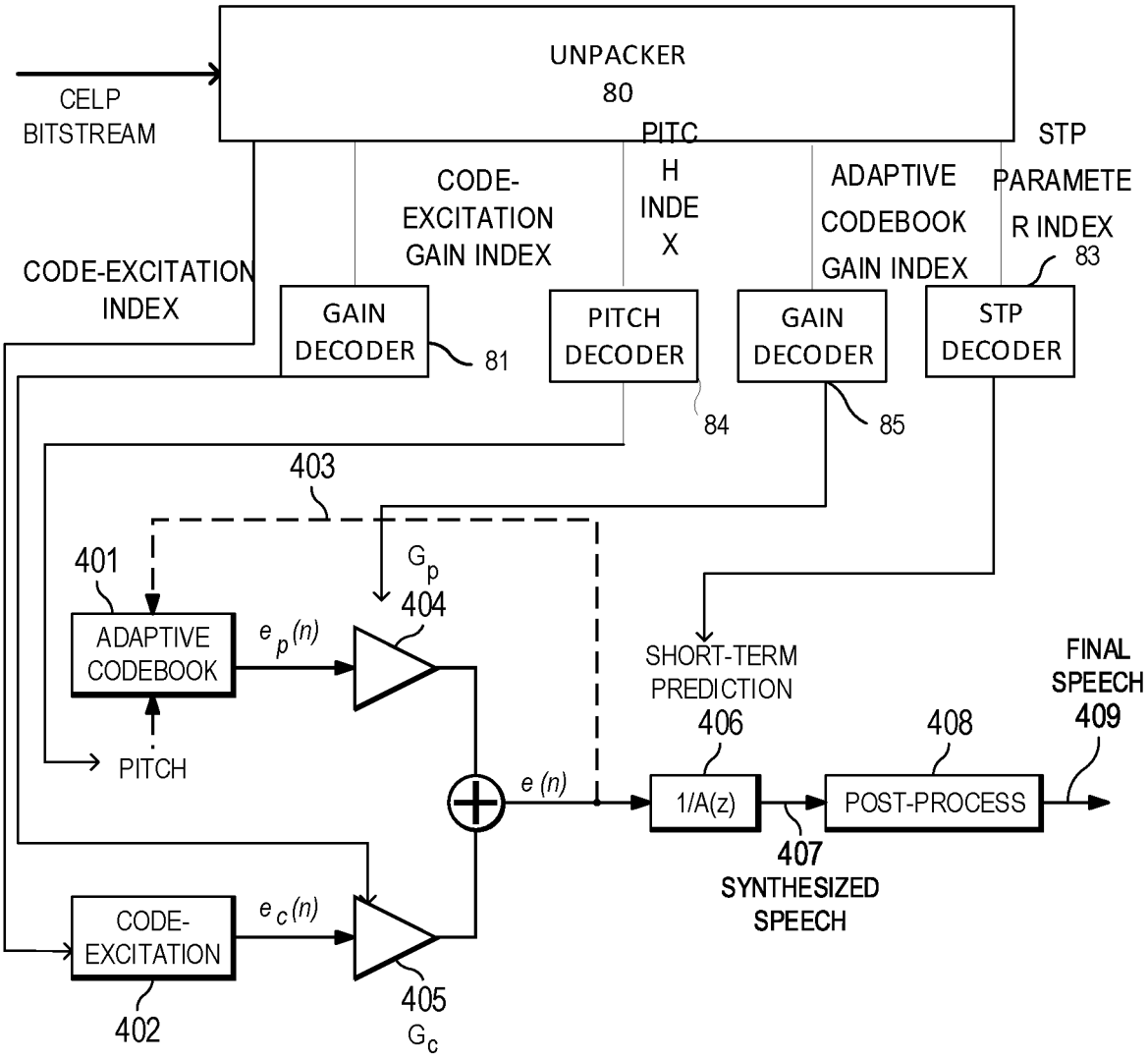
FIG. 4 illustrates a basic CELP decoder corresponding to the encoder in FIG. 3.

The CELP bitstream coded using a device illustrated in FIG. 3 is received at a receiving device. FIG. 4 illustrate the corresponding decoder of the receiving device.

FIG. 4 illustrates a basic CELP decoder corresponding to the encoder in FIG. 3. FIG. 4 includes a post-processing block 408 receiving the synthesized speech 407 from the main decoder. This decoder is similar to FIG. 3 except the adaptive codebook 307.

For each subframe received, the received coded excitation index, quantized coded excitation gain index, quantized pitch index, quantized adaptive codebook gain index, and quantized short-term prediction parameter index, are used to find the corresponding parameters using corresponding decoders, for example, gain decoder 81, pitch decoder 84, adaptive codebook gain decoder 85, and short-term prediction decoder 83.

In various embodiments, the CELP decoder is a combination of several blocks and comprises coded excitation 402, adaptive codebook 401, short-term prediction 406, and post-processing 408. Every block except post-processing has the same definition as described in the encoder of FIG. 3. The post-processing may further include short-term post-processing and long-term post-processing.

The code-excitation block (referenced with label 308 in FIGS. 3 and 402 in FIG. 4) illustrates the location of Fixed Codebook (FCB) for a general CELP coding. A selected code vector from FCB is scaled by a gain often noted as $G_c$ 306.

Figure 5:
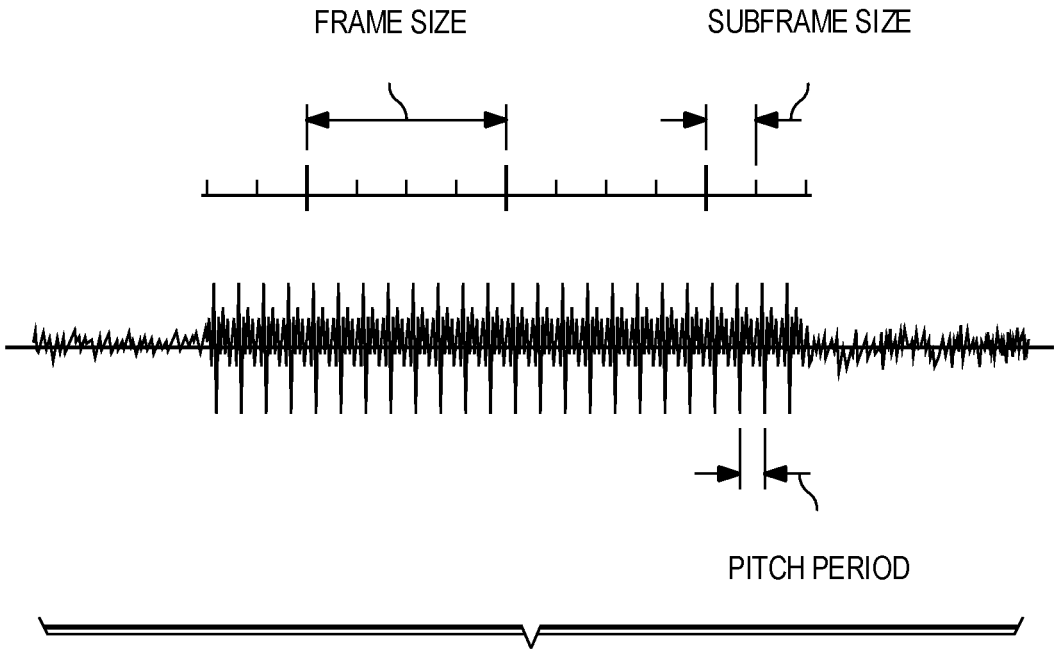
Figure 5 (PRIOR ART)
FIGS. 5 and 6 illustrate examples of schematic speech signals and it's relationship to frame size and subframe size in the time domain.
Figure 6:
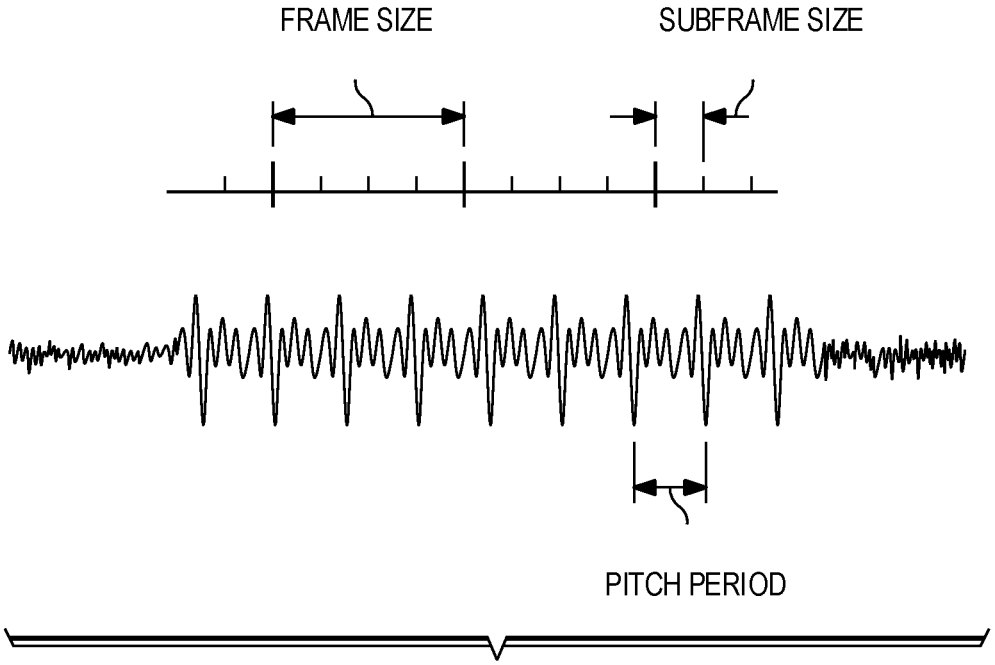
Figure 6 (PRIOR ART)

FIGS. 5 and 6 illustrate examples of schematic speech signals and it's relationship to frame size and subframe size in the time domain. FIGS. 5 and 6 illustrate a frame including a plurality of subframes.

The samples of the input speech are divided into blocks of samples each, called frames, e.g., 80-240 samples or frames. Each frame is divided into smaller blocks of samples, each, called subframes. At the sampling rate of 8 kHz, 12.8 kHz, or 16 kHz, the speech coding algorithm is such that the nominal frame duration is in the range of ten to thirty milliseconds, and typically twenty milliseconds. In the illustrated FIG. 5, the frame has a frame size 1 and a subframe size 2, in which each frame is divided into 4 subframes.

Referring to the lower or bottom portions of FIGS. 5 and 6, the voiced regions in a speech look like a near periodic signal in the time domain representation. The periodic opening and closing of the vocal folds of the speaker results in the harmonic structure in voiced speech signals. Therefore, over short periods of time, the voiced speech segments may be treated to be periodic for all practical analysis and processing. The periodicity associated with such segments is defined as "Pitch Period" or simply "pitch" in the time domain and "Pitch frequency or Fundamental Frequency $f_0$" in the frequency domain. The inverse of the pitch period is the fundamental frequency of speech. The terms pitch and fundamental frequency of speech are frequently used interchangeably.

For most voiced speech, one frame contains more than two pitch cycles. FIG. 5 further illustrates an example that the pitch period 3 is smaller than the subframe size 2. In contrast, FIG. 6 illustrates an example in which the pitch period 4 is larger than the subframe size 2 and smaller than the half frame size.

In order to encode speech signal more efficiently, speech signal may be classified into different classes and each class is encoded in a different way. For example, in some standards such as G.718, VMR-WB, or AMR-WB, speech signal is classified into UNVOICED, TRANSITION, GENERIC, VOICED, and NOISE.

For each class, LPC or STP filter is always used to represent spectral envelope. However, the excitation to the LPC filter may be different. UNVOICED and NOISE classes may be coded with a noise excitation and some excitation enhancement. TRANSITION class may be coded with a pulse excitation and some excitation enhancement without using adaptive codebook or LTP.

GENERIC may be coded with a traditional CELP approach such as Algebraic CELP used in G.729 or AMR-WB, in which one 20 ms frame contains four 5 ms subframes. Both the adaptive codebook excitation component and the fixed codebook excitation component are produced with some excitation enhancement for each subframe. Pitch lags for the adaptive codebook in the first and third subframes are coded in a full range from a minimum pitch limit PIT_MIN to a maximum pitch limit PIT_MAX. Pitch lags for the adaptive codebook in the second and fourth subframes are coded differentially from the previous coded pitch lag.

VOICED classes may be coded in such a way that they are slightly different from GENERIC class. For example, pitch lag in the first subframe may be coded in a full range from a minimum pitch limit PIT_MIN to a maximum pitch limit PIT_MAX. Pitch lags in the other subframes may be coded differentially from the previous coded pitch lag. As an illustration, supposing the excitation sampling rate is 12.8 kHz, then the example PIT_MIN value can be 34 and PIT_MAX can be 231.

Embodiments of the present invention to improve classification of time domain coding and frequency domain coding will be now described.

Generally speaking, it is better to use time domain coding for speech signal and frequency domain coding for music signal in order to achieve best quality at a quite high bit rate (for example, 24 kbps<=bit rate<=64 kbps). However, for some specific speech signal such as short pitch signal, singing speech signal, or very noisy speech signal, it may be better to use frequency domain coding. For some specific music signals such as very periodic signal, it may be better to use time domain coding by benefiting from very high LTP gain. Bit rate is an important parameter for classification. Usually, time domain coding favors low bit rate and frequency domain coding favors high bit rate. A best classification or selection between time domain coding and frequency domain coding needs to be decided carefully, considering also bit rate range and characteristic of coding algorithms.

In the next sections, the detection of normal speech and short pitch signal will be described.

Normal speech is a speech signal which excludes singing speech signal, short pitch speech signal, or speech/music mixed signal. Normal speech can also be fast changing speech signal, the spectrum and/or energy of which changes faster than most music signals. Normally, time domain coding algorithm is better than frequency domain coding algorithm for coding normal speech signal. The following is an example algorithm to detect normal speech signal.

For a pitch candidate P, the normalized pitch correlation is often defined in mathematical form as in Equation (8).

$$R(P) = \frac{\sum_n s_w(n) \cdot s_w(n-P)}{\sqrt{\sum_n \|s_w(n)\|^2 \cdot \sum_n \|s_w(n-P)\|^2}} \tag{8}$$

In Equation (8), $s_w$*n) is a weighted speech signal, the numerator is correlation, and the denominator is an energy normalization factor. Suppose Voicing notes the average normalized pitch correlation value of the four subframes in the current speech frame, Voicing may be computed as in Equation (9) below.

$$\text{Voicing}=[R_1(P_1)+R_2(P_2)+R_3(P_3)+R_4(P_4)]/4 \tag{9}$$

$R_1(P_1)$, $R_2(P_2)$, $R_3(P_3)$, and $R_4(P_4)$ are the four normalized pitch correlations calculated for each subframe; $P_1$, $P_2$, $P_3$, and $P_4$ for each subframe are the best pitch candidates found in the pitch range from P=PIT_MIN to P=PIT_MAX. The smoothed pitch correlation from previous frame to current frame can be calculated as in Equation (10).

```
if ((Voicing>Voicing_sm) and (speech_class≠UNVOICED))

Voicing_sm⇐(3·Voicing_sm+Voicing)/4

else if (VAD=1)

Voicing_sm⇐(31·Voicing_sm+Voicing)/32
```
(10)

In Equation (10), VAD is Voice Activity Detection and VAD=1 references that the speech signal exits. Suppose $F_s$ is the sampling rate, the maximum energy in the very low frequency region [0, $F_{MIN}$=$F_s$/PIT_MIN] (Hz) is Energy0 (dB), the maximum energy in the low frequency region [$F_{MIN}$, 900] (Hz) is Energy1 (dB), and the maximum energy in the high frequency region [5000, 5800] (Hz) is Energy3 (dB), a spectral tilt parameter Tilt is defined as follows.

$$\text{Tilt}=\text{energy3}-\max\{\text{energy0},\text{energy1}\} \tag{11}$$

A smoothed spectral tilt parameter is noted as in Equation (12).

$$\text{Tilt_}sm\Leftarrow(7\cdot\text{Tilt_}sm+\text{Tilt})/8 \tag{12}$$

A difference spectral tilt of the current frame and the previous frame may be given as in Equation (13).

$$\text{Diff_tilt}=|\text{tilt}-\text{old_tilt}| \tag{13}$$

A smoothed difference spectral tilt is given as in Equation (14).

```
if ((Diff_tilt>Diff_tilt_sm) and (speech_class≠UNVOICED))

Diff_tilt_sm⇐(3·Diff_tilt_sm+Diff_tilt)/4

else if (VAD=1)

Diff_tilt_sm⇐(31·Diff_tilt_sm+Diff_tilt)/32
```
(14)

A difference low frequency energy of the current frame and the previous frame is $$\text{Diff_energy1}=|\text{energy1}-\text{old_energy1}| \tag{15}$$

A smoothed difference energy is given by Equation (16).

```
if ((Diff_energy1>Diff_energy1_sm) and (speech_class≠UNVOICED))

Diff_energy1_sm⇐(3·Diff_energy1_sm+Diff_energy1)/4

else if (VAD=1)

Diff_energy1_sm⇐(31·Diff_energy1_sm+Diff_energy1)/32
```
(16)

Additionally, a normal speech flag denoted as Speech_flag is decided and changed during voiced area by considering energy variation Diff_energy1_sm, voicing variation Voicing_sm, and spectral tilt variation Diff_tilt_sm as provided in Equation (17).

```
if (speech_class ≠ UNVOICED ) {
   Diff_Sp = Diff_energy1_sm · Voicing_sm · Diff_tilt_sm
   if (Diff_Sp > 800) Speech_flag = 1 // switch to normal speech          (17)
   if (Diff_Sp < 100) Speech_flag = 0 // switch to non normal speech
}
```

Embodiments of the present invention for detecting short pitch signal will be described.

Most CELP codecs work well for normal speech signals. However, low bit rate CELP codecs often fail for music signals and/or singing voice signals. If the pitch coding range is from PIT_MIN to PIT_MAX and the real pitch lag is smaller than PIT_MIN, the CELP coding performance may be bad perceptually due to double pitch or triple pitch. For example, the pitch range from PIT_MIN=34 to PIT_MAX=231 for $F_s$=12.8 kHz sampling frequency adapts most human voices. However, real pitch lag of regular music or singing voiced signal may be much shorter than the minimum limitation PIT_MIN=34 defined in the above example CELP algorithm.

When the real pitch lag is P, the corresponding normalized fundamental frequency (or first harmonic) is $f_0=F_s/P$, where $F_s$ is the sampling frequency and $f_0$ is the location of the first harmonic peak in spectrum. So, for a given sampling frequency, the minimum pitch limitation PIT_MIN actually defines the maximum fundamental harmonic frequency limitation $F_M=F_s$/PIT_MIN for CELP algorithm.

Figure 7:
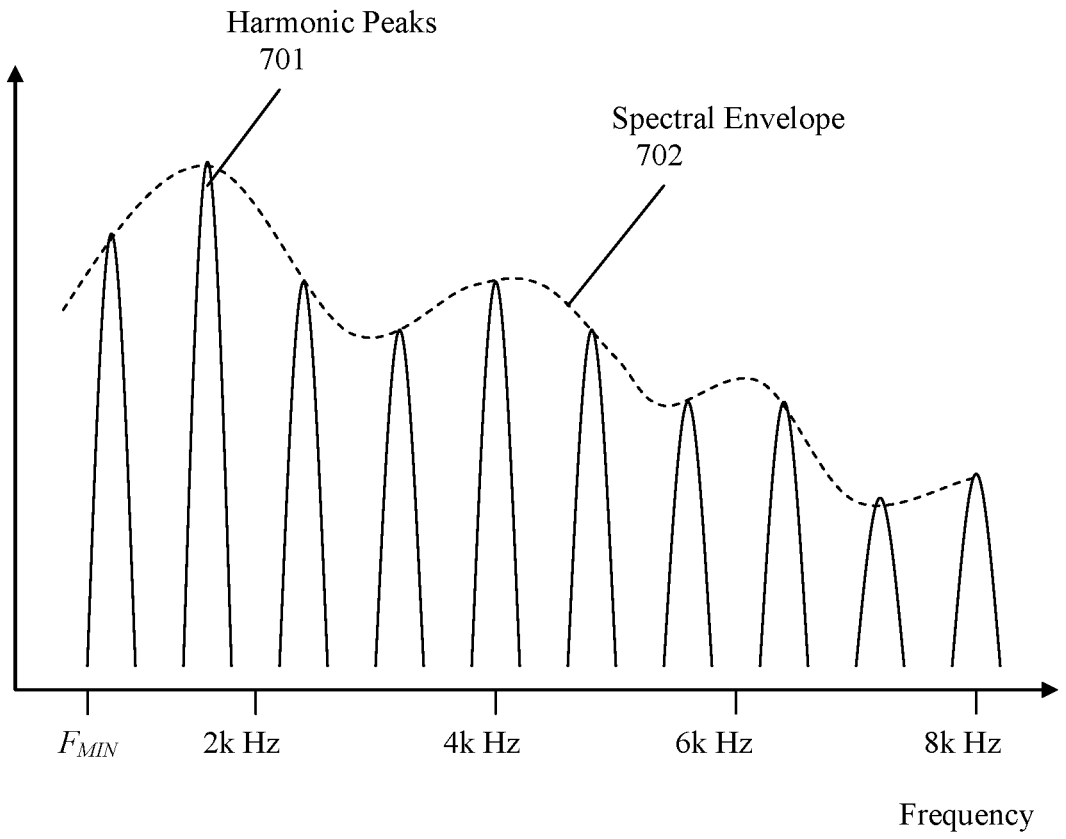
FIG. 7 illustrates an example of an original voiced wideband spectrum.
Figure 8:
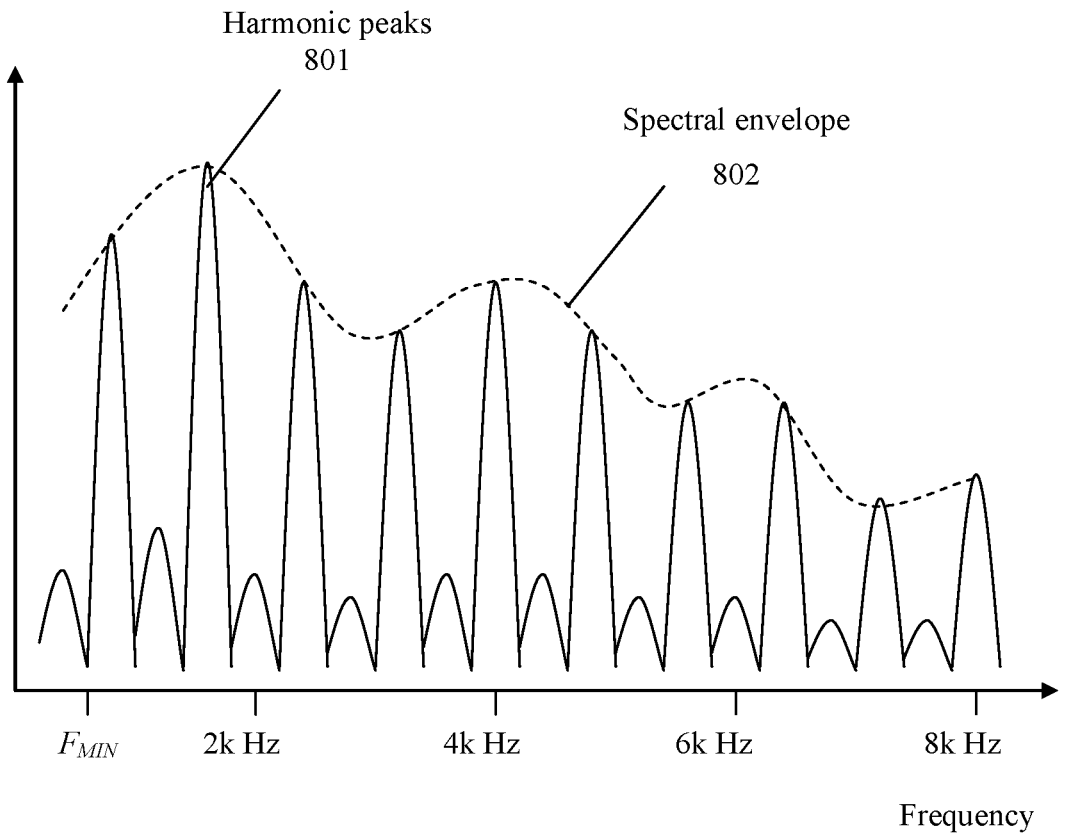
FIG. 8 illustrates a coded voiced wideband spectrum of the original voiced wideband spectrum illustrated in FIG. 7 using doubling pitch lag coding.

FIG. 7 illustrates an example of an original voiced wideband spectrum. FIG. 8 illustrates a coded voiced wideband spectrum of the original voiced wideband spectrum illustrated in FIG. 7 using doubling pitch lag coding. In other words, FIG. 7 illustrates a spectrum prior to coding and FIG. 8 illustrates the spectrum after coding.

In the example shown in FIG. 7, the spectrum is formed by harmonic peaks 701 and spectral envelope 702. The real fundamental harmonic frequency (the location of the first harmonic peak) is already beyond the maximum fundamental harmonic frequency limitation $F_M$ so that the transmitted pitch lag for CELP algorithm is not able to be equal to the real pitch lag and it could be double or multiple of the real pitch lag The wrong pitch lag transmitted with multiple of the real pitch lag can cause obvious quality degradation. In other words, when the real pitch lag for harmonic music signal or singing voice signal is smaller than the minimum lag limitation PIT_MIN defined in CELP algorithm, the transmitted lag could be double, triple or multiple of the real pitch lag.

As a result, the spectrum of the coded signal with the transmitted pitch lag could be as shown in FIG. 8. As illustrated in FIG. 8, besides including harmonic peaks 8011 and spectral envelope 802, unwanted small peaks 803 between the real harmonic peaks can be seen while the correct spectrum should be like the one in FIG. 7. Those small spectrum peaks in FIG. 8 could cause uncomfortable perceptual distortion.

In accordance with embodiments of the present invention, one solution to solve this problem when CELP fails for some specific signals is that a frequency domain coding is used instead of time domain coding.

Usually, music harmonic signals or singing voice signals are more stationary than normal speech signals. Pitch lag (or fundamental frequency) of normal speech signal keeps changing all the time. However, pitch lag (or fundamental frequency) of music signal or singing voice signal often maintains relatively slow changing for quite long time duration. The very short pitch range is defined from PIT_MINo to PIT_MIN. At the sampling frequency Fs=12.8 kHz, an example definition of the very short pitch range can be from PIT_MINo<=17 to PIT_MIN=34. As the pitch candidate is so short, the energy from 0 Hz to $F_{MIN}$=Fs/PIT_MIN Hz must be relatively low enough. Other conditions such as Voice Activity Detection and Voiced Classification may be added during detection of existence of short pitch signal.

The following two parameters can help detect the possible existence of very short pitch signal. One features "Lack of Very Low Frequency Energy" and another one features "Spectral Sharpness". As already mentioned above, suppose the maximum energy in the frequency region [0, $F_{MIN}$] (Hz) is Energy0 (dB), the maximum energy in the frequency region [$F_{MIN}$, 900] (Hz) is Energy1 (dB), the relative energy ratio between Energy0 and Energy1 is provided in Equation (18) below.

$$\text{Ratio}=\text{Energy1}-\text{Energy0} \tag{18}$$

This energy ratio can be weighted by multiplying an average normalized pitch correlation value Voicing, which is shown below in Equation (19).

$$\text{Ratio} \Leftarrow \text{Ratio}\cdot\max\{\text{Voicing},0.5\} \tag{19}$$

The reason for doing the weighting in Equation (19) by using a Voicing factor is that short pitch detection is meaningful for voiced speech or harmonic music, and it is not meaningful for unvoiced speech or non-harmonic music. Before using the Ratio parameter to detect the lack of low frequency energy, it is better to be smoothed in order to reduce the uncertainty as in Equation (20).

```
if (VAD = 1) {
    LF_EnergyRatio_sm ⇐ (15·LF_EnergyRatio_sm+Ratio)/16    (20)
}
```

If LF_lack_flag=1 means the lack of low frequency energy is detected (otherwise LF_lack_flag=0), LF_lack_flag can be determined by the following procedure.

```
if ((LF_EnergyRatio_sm>30) or (Ratio>48) or
      (LF_EnergyRatio_sm>22 and Ratio>38) ) {
            LF_lack_flag=1 ;
}
else if (LF_EnergyRatio_sm <13) {
            LF_lack_flag=0 ;
}
else {
            LF_lack_flag keeps unchanged.
}
```

Spectral Sharpness related parameters are determined in the following way. Suppose Energy1 (dB) is the maximum energy in the low frequency region [$F_{MIN}$, 900] (Hz), i_peak is the maximum energy harmonic peak location in the frequency region [$F_{MIN}$,900] (Hz) and Energy2 (dB) is the average energy in the frequency region [i_peak,i_peak+400] (Hz). One spectral sharpness parameter is defined as in Equation (21).

$$SpecSharp=\max\{Energy1-Energy2,0\} \quad (21)$$

A smoothed spectral sharpness parameter is given as follows.

```
if (VAD=1) {
    SpecSharp_sm = (7 · SpecSharp_sm + SpecSharp)/8
}
```

One spectral sharpness flag indicating the possible existence of short pitch signal is evaluated by the following.

```
if ( SpecSharp_sm>50 or SpecSharp>80 ) {
    SpecSharp_flag=1; //possible short pitch or tones
}
if ( SpecSharp_sm<8 ) {
    SpecSharp_flag=0;
}
if non of the above conditions are satisfied, SpecSharp_flag keeps
unchanged.
```

In various embodiments, the above estimated parameters can be used to improve classification or selection of time domain coding and frequency domain coding. Suppose Sp_Aud_Deci=1 denotes that frequency domain coding is selected and Sp_Aud_Deci=0 denotes that time domain coding is selected. The following procedure gives an example algorithm to improve classification of time domain coding and frequency domain coding for different coding bit rates.

Embodiments of the present invention may be used to improve high bit rates, for example, coding bit rate is greater than or equal to 46200 bps. When coding bit rate is very high and short pitch signal possibly exists, frequency domain coding is selected because frequency domain coding can deliver robust and reliable quality while time domain coding risks bad influence from wrong pitch detection. In contrast, when short pitch signal does not exist and signal is unvoiced speech or normal speech, time domain coding is selected because time domain coding can delivers better quality than frequency domain coding for normal speech signal.

```
/* for possible short pitch signal, select frequency domain
coding */
if (LF_lack_flag=1 or SpecSharp_flag=1) {
    Sp_Aud_Deci = 1; // select frequency domain coding
}
/* for unvoiced speech or normal speech , select time domain
coding */
if (LF_lack_flag=0 and SpecSharp_flag=0) {
    if ( (Tilt>40) and (Voicing<0.5) and
    (speech_class=UNVOICED) and
      (VAD=1) ) {
        Sp_Aud_Deci = 0; // select time domain coding
    }
    if (Speech_flag=1) {
        Sp_Aud_Deci = 0; // select time domain coding
}
}
```

Embodiments of the present invention may be used to improve intermediate bit rate coding, for example, when coding bit rate is between 24.4 kbps and 46200 bps. When short pitch signal possibly exists and voicing periodicity is low, frequency domain coding is selected because frequency domain coding can deliver robust and reliable quality while time domain coding risks bad influence from low voicing periodicity. When short pitch signal does not exist and signal is unvoiced speech or normal speech, time domain coding is selected because time domain coding can delivers better quality than frequency domain coding for normal speech signal. When the voicing periodicity is very strong, time domain coding is selected because time domain coding can benefit a lot from high LTP gain with very strong voicing periodicity.

Embodiments of the present invention may also be used to improve high bit rates, for example, coding bit rate is less than 24.4 kbps. When short pitch signal exists and voicing periodicity is not low with correct short pitch lag detection, frequency domain coding is not selected because frequency domain coding can not deliver robust and reliable quality at low rate while time domain coding can benefit well from the LTP function.

The following algorithm illustrates a specific embodiment of the above embodiments as an illustration. All parameters may be computed as described previously in one or more embodiments.

```
/* prepare parameters or thresholds */
  if ( previous frame is time domain coding ) {
  DPIT=0.4;
 TH1=0.92;
 TH2=0.8;
  }
  else {
  DPIT=0.9;
 TH1=0.9;
 TH2=0.7;
  }
 Stab _ Pitch _ Flag = (|P0 − P1| < DPIT ) and (|P1 − P2| < DPIT ) and (|P2 − P3| <
DPIT ) ;
 High_Voicing = (Voicing_sm>TH1) and (Voicing>TH2) ;
/* for possible short pitch signal with low periodicity (low voicing), select frequency
domain
coding */
if ( (LF_lack_flag=1) or (SpecSharp_flag=1) ) {
  if (   ( (Stab_Pitch_Flag=0 or High_Voicing=0) and ( Tilt_sm<=−50) )
    or (Tilt_sm<=−60) )
 {
  Sp_Aud_Deci = 1; // select frequency domain coding
  }
}
/* for unvoiced signal or normal speech signal, select time domain coding */
```

-continued

```
if ( LF_lack_flag=0 and SpecSharp_flag=0 )
{
  if ( Tilt>40 and Voicing<0.5 and speech_class=UNVOICED and Vad=1)
{
  Sp_Aud_Deci = 0; // select time domain coding
}
  if ( Speech_flag=1)
 {
Sp_Aud_Deci = 0; // select time domain coding
  }
}
/* for strong voicing signal, select time domain coding */
  if ( Ttilt_sm>-60 and ( speech_class is not UNVOICED ) )
{
  if ( High_Voicing=1 and
      (Stab_Pitch_Flag=1 or (LF_lack_flag=0 and SpecSharp_flag=0) )   )
{
  Sp_Aud_Deci = 0;   // select time domain coding
  }
}
```

In various embodiments, the classification or selection of time domain coding and frequency domain coding may be used to significantly improve perceptual quality of some specific speech signals or music signal.

Audio coding based on filter bank technology is widely used in frequency domain coding. In signal processing, a filter bank is an array of band-pass filters that separates the input signal into multiple components, each one carrying a single frequency subband of the original input signal. The process of decomposition performed by the filter bank is called analysis, and the output of filter bank analysis is referred to as a subband signal having as many subbands as there are filters in the filter bank. The reconstruction process is called filter bank synthesis. In digital signal processing, the term filter bank is also commonly applied to a bank of receivers, which also may down-convert the subbands to a low center frequency that can be re-sampled at a reduced rate. The same synthesized result can sometimes be also achieved by undersampling the bandpass subbands. The output of filter bank analysis may be in a form of complex coefficients. Each complex coefficient having a real element and imaginary element respectively representing a cosine term and a sine term for each subband of filter bank.

Filter-Bank Analysis and Filter-Bank Synthesis is one kind of transformation pair that transforms a time domain signal into frequency domain coefficients and inverse-transforms frequency domain coefficients back into a time domain signal. Other popular transformation pairs, such as (FFT and iFFT), (DFT and iDFT), and (MDCT and iMDCT), may be also used in speech/audio coding.

In the application of filter banks for signal compression, some frequencies are perceptually more important than others. After decomposition, perceptually significant frequencies can be coded with a fine resolution, as small differences at these frequencies are perceptually noticeable to warrant using a coding scheme that preserves these differences. On the other hand, less perceptually significant frequencies are not replicated as precisely. Therefore, a coarser coding scheme can be used, even though some of the finer details will be lost in the coding. A typical coarser coding scheme may be based on the concept of Bandwidth Extension (BWE), also known High Band Extension (HBE). One recently popular specific BWE or HBE approach is known as Sub Band Replica (SBR) or Spectral Band Replication (SBR). These techniques are similar in that they encode and decode some frequency sub-bands (usually high bands) with little or no bit rate budget, thereby yielding a significantly lower bit rate than a normal encoding/decoding approach. With the SBR technology, a spectral fine structure in high frequency band is copied from low frequency band, and random noise may be added. Next, a spectral envelope of the high frequency band is shaped by using side information transmitted from the encoder to the decoder.

Use of psychoacoustic principle or perceptual masking effect for the design of audio compression makes sense. Audio/speech equipment or communication is intended for interaction with humans, with all their abilities and limitations of perception. Traditional audio equipment attempts to reproduce signals with the utmost fidelity to the original. A more appropriately directed and often more efficient goal is to achieve the fidelity perceivable by humans. This is the goal of perceptual coders.

Although one main goal of digital audio perceptual coders is data reduction, perceptual coding may also be used to improve the representation of digital audio through advanced bit allocation. One of the examples of perceptual coders could be multiband systems, dividing up the spectrum in a fashion that mimics the critical bands of psychoacoustics. By modeling human perception, perceptual coders can process signals much the way humans do, and take advantage of phenomena such as masking. While this is their goal, the process relies upon an accurate algorithm. Due to the fact that it is difficult to have a very accurate perceptual model which covers common human hearing behavior, the accuracy of any mathematical expression of perceptual model is still limited. However, with limited accuracy, the perception concept has helped in the design of audio codecs. Numerous MPEG audio coding schemes have benefited from exploring perceptual masking effect. Several ITU standard codecs also use the perceptual concept. For example, ITU G.729.1 performs so-called dynamic bit allocation based on perceptual masking concept. The dynamic bit allocation concept based on perceptual importance is also used in recent 3GPP EVS codec.

Figure 9A:
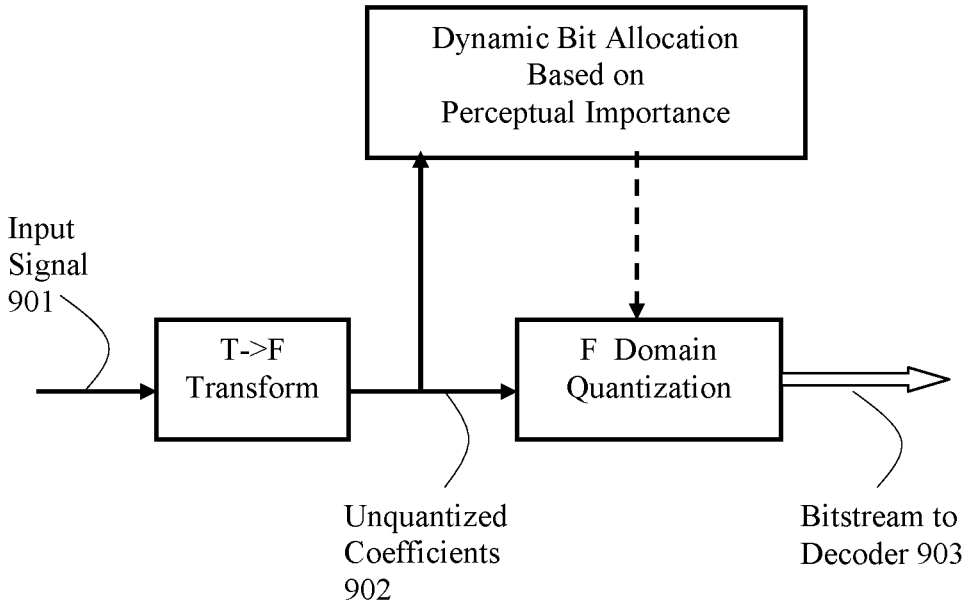
Figure 9B:
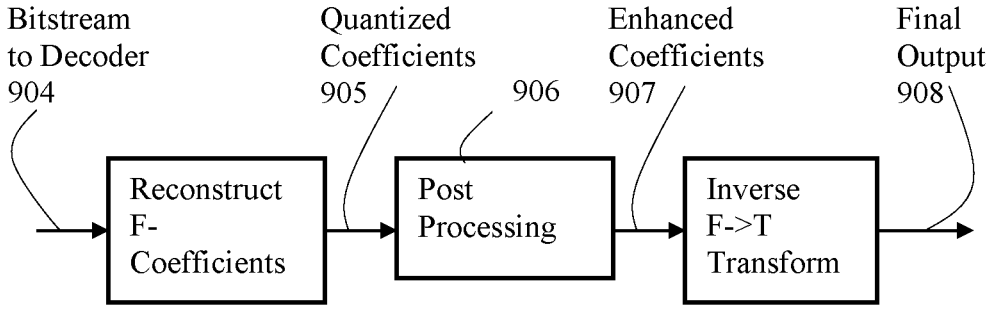

FIGS. 9A and 9B illustrate the schematic of a typical frequency domain perceptual codec. FIG. 9A illustrates a frequency domain encoder whereas FIG. 9B illustrates a frequency domain decoder.

The original signal 901 is first transformed into frequency domain to get unquantized frequency domain coefficients 902. Before quantizing the coefficients, the masking function (perceptual importance) divides the frequency spectrum into many subbands (often equally spaced for the simplicity). Each subband dynamically allocates the needed number of bits while maintaining the total number of bits distributed to all subbands is not beyond the upper limit. Some subbands may be allocated 0 bit if it is judged to be under the masking threshold. Once a determination is made as to what can be discarded, the remainder is allocated the available number of bits. Because bits are not wasted on masked spectrum, they can be distributed in greater quantity to the rest of the signal.

According to allocated bits, the coefficients are quantized and the bitstream 703 is sent to decoder. Although the perceptual masking concept helped a lot during codec design, it is still not perfect due to various reasons and limitations.

Referring to FIG. 9B, the decoder side post-processing can further improve the perceptual quality of decoded signal produced with limited bit rates. The decoder first uses the received bits 904 to reconstruct the quantized coefficients 905. Then, they are post-processed by a properly designed module 906 to get the enhanced coefficients 907. An inverse-transformation is performed on the enhanced coefficients to have the final time domain output 908.

Figure 10:
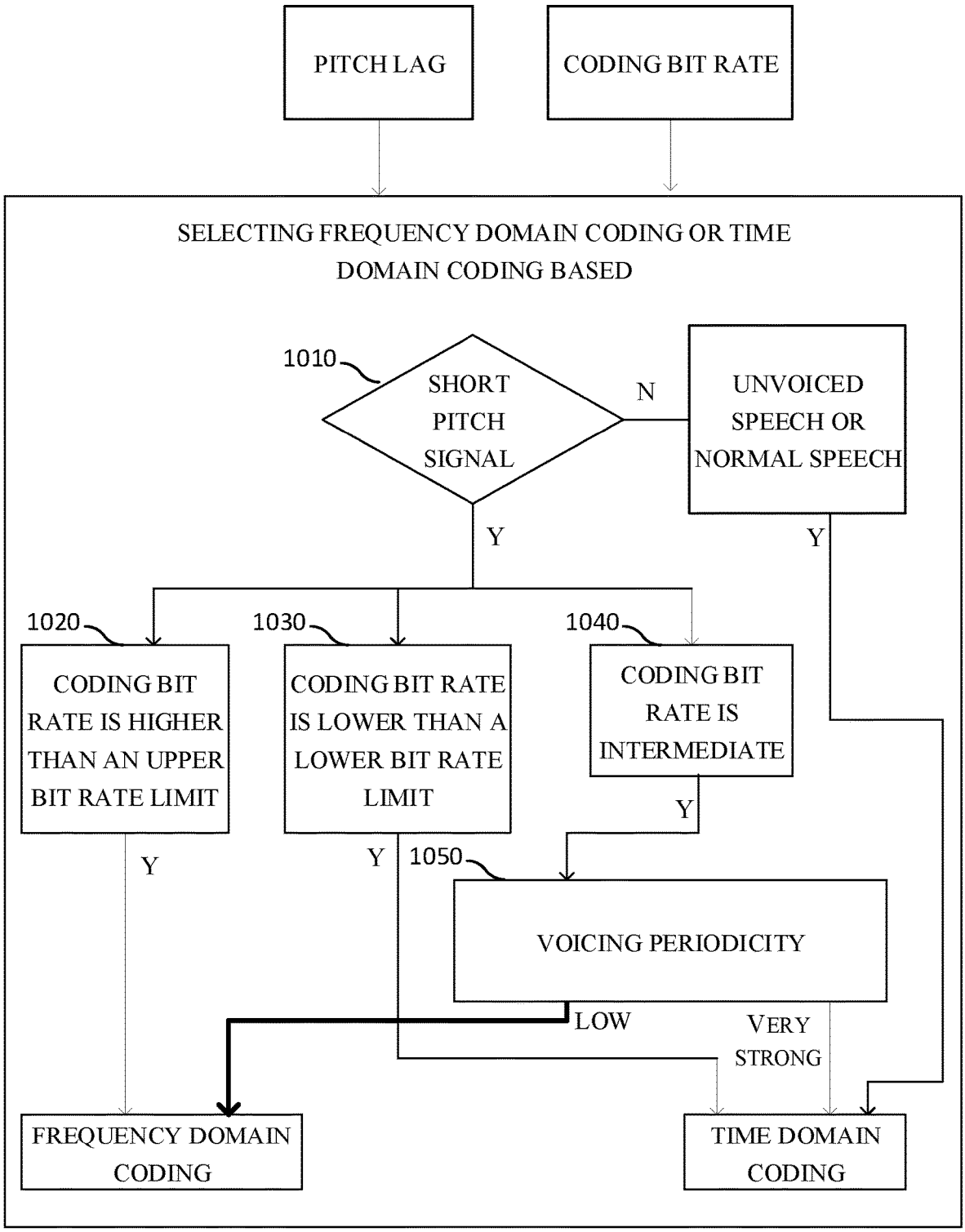
FIG. 10 illustrates a schematic of the operations at an encoder prior to encoding a speech signal comprising audio data in accordance with embodiments of the present invention.

FIG. 10 illustrates a schematic of the operations at an encoder prior to encoding a speech signal comprising audio data in accordance with embodiments of the present invention.

Referring to FIG. 10, the method comprises selecting frequency domain coding or time domain coding (box 1000) based on a coding bit rate to be used for coding the digital signal and a pitch lag of the digital signal.

The selection of the frequency domain coding or time domain coding comprises the step of determining whether the digital signal comprises a short pitch signal for which the pitch lag is shorter than a pitch lag limit (box 1010). Further, it is determined whether the coding bit rate is higher than an upper bit rate limit (box 1020). If the digital signal comprises a short pitch signal and the coding bit rate is higher than an upper bit rate limit, frequency domain coding is selected for coding the digital signal.

Otherwise, it is determined whether the coding bit rate is lower than a lower bit rate limit (box 1030). If the digital signal comprises a short pitch signal and the coding bit rate is lower than a lower bit rate limit, time domain coding is selected for coding the digital signal.

Otherwise, it is determined whether the coding bit rate is intermediate between a lower bit rate limit and an upper bit rate limit (box 1040). The voicing periodicity is next determined (box 1050). If the digital signal comprises a short pitch signal and the coding bit rate is intermediate and the voicing periodicity is low, frequency domain coding is selected for coding the digital signal. Alternatively, if the digital signal comprises a short pitch signal and the coding bit rate is intermediate and the voicing periodicity is very strong, time domain coding is selected for coding the digital signal.

Alternatively, referring to box 1010, the digital signal does not comprise a short pitch signal for which the pitch lag is shorter than a pitch lag limit. It is determined whether the digital signal is classified as unvoiced speech or normal speech (box 1070). If the digital signal does not comprise a short pitch signal and if the digital signal is classified as unvoiced speech or normal speech, time domain coding is selected for coding the digital signal.

Accordingly, in various embodiments, a method for processing speech signals prior to encoding a digital signal comprising audio data includes selecting frequency domain coding or time domain coding based on a coding bit rate to be used for coding the digital signal and a short pitch lag detection of the digital signal. The digital signal comprises a short pitch signal for which the pitch lag is shorter than a pitch lag limit. In various embodiments, the method of selecting frequency domain coding or time domain coding comprises selecting frequency domain coding for coding the digital signal when a coding bit rate is higher than an upper bit rate limit, and selecting time domain coding for coding the digital signal when the coding bit rate is lower than a lower bit rate limit. The coding bit rate is higher than the upper bit rate limit when the coding bit rate is greater than or equal to 46200 bps. The coding bit rate is lower than a lower bit rate limit when the coding bit rate is less than 24.4 kbps.

Similarly, in another embodiment, a method for processing speech signals prior to encoding a digital signal comprising audio data comprises selecting frequency domain coding for coding the digital signal when a coding bit rate is higher than an upper bit rate limit. Alternatively, the method selects time domain coding for coding the digital signal when the coding bit rate is lower than a lower bit rate limit. The digital signal comprises a short pitch signal for which the pitch lag is shorter than a pitch lag limit. The coding bit rate is higher than the upper bit rate limit when the coding bit rate is greater than or equal to 46200 bps. The coding bit rate is lower than a lower bit rate limit when the coding bit rate is less than 24.4 kbps.

Similarly, in another embodiment, a method for processing speech signals prior to encoding comprises selecting time domain coding for coding a digital signal comprising audio data when the digital signal does not comprise short pitch signal and the digital signal is classified as unvoiced speech or normal speech. The method further comprises selecting frequency domain coding for coding the digital signal when coding bit rate is intermediate between a lower bit rate limit and an upper bit rate limit. The digital signal comprises short pitch signal and voicing periodicity is low. The method further includes selecting time domain coding for coding the digital signal when coding bit rate is intermediate and the digital signal comprises short pitch signal and a voicing periodicity is very strong. The lower bit rate limit is 24.4 kbps and the upper bit rate limit is 46.2 kbps.

Figure 11:
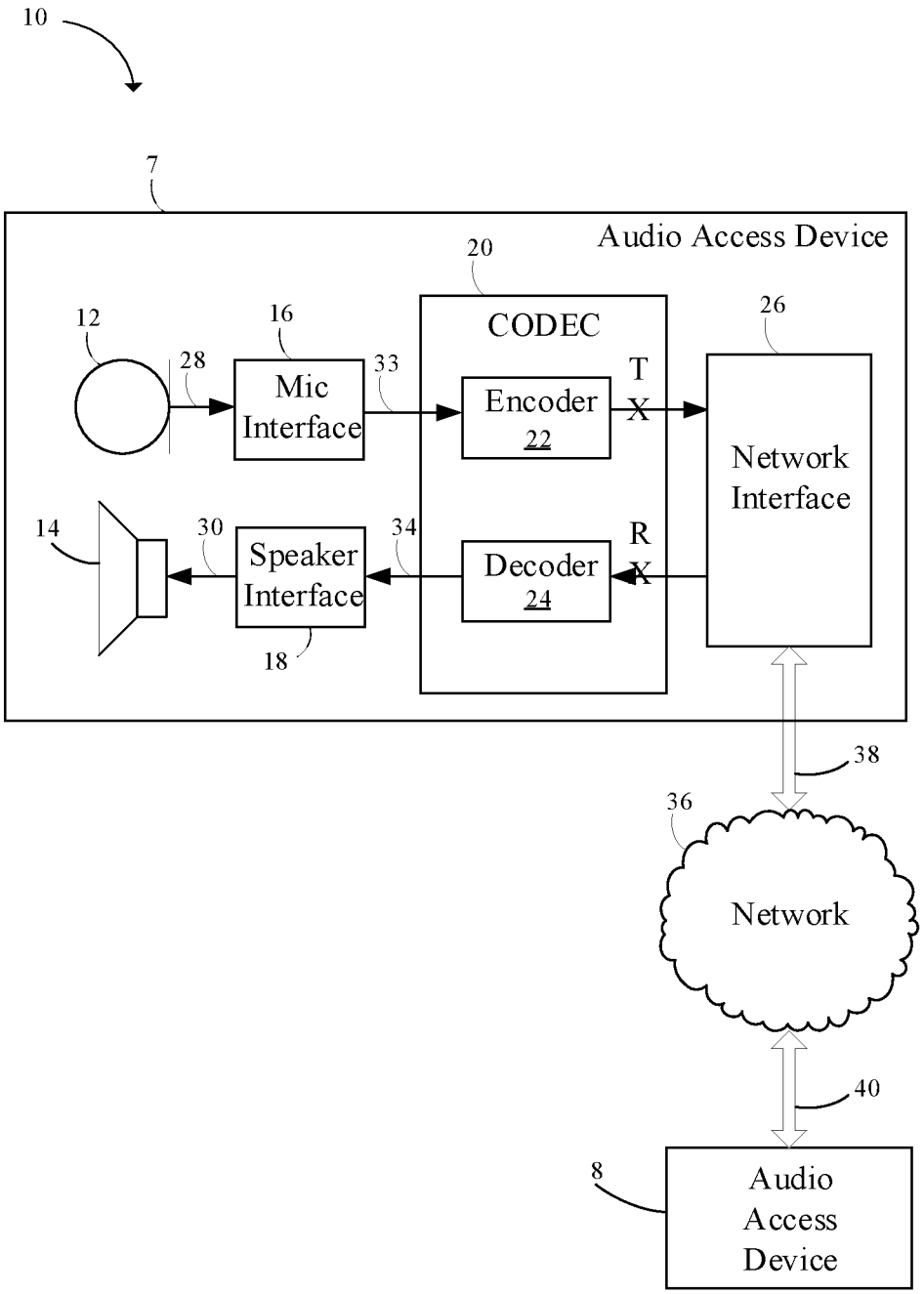
FIG. 11 illustrates a communication system 10 according to an embodiment of the present invention.

FIG. 11 illustrates a communication system 10 according to an embodiment of the present invention.

Communication system 10 has audio access devices 7 and 8 coupled to a network 36 via communication links 38 and 40. In one embodiment, audio access device 7 and 8 are voice over internet protocol (VOIP) devices and network 36 is a wide area network (WAN), public switched telephone network (PTSN) and/or the internet. In another embodiment, communication links 38 and 40 are wireline and/or wireless broadband connections. In an alternative embodiment, audio access devices 7 and 8 are cellular or mobile telephones, links 38 and 40 are wireless mobile telephone channels and network 36 represents a mobile telephone network.

The audio access device 7 uses a microphone 12 to convert sound, such as music or a person's voice into an analog audio input signal 28. A microphone interface 16 converts the analog audio input signal 28 into a digital audio signal 33 for input into an encoder 22 of a CODEC 20. The encoder 22 produces encoded audio signal TX for transmission to a network 26 via a network interface 26 according to embodiments of the present invention. A decoder 24 within the CODEC 20 receives encoded audio signal RX from the network 36 via network interface 26, and converts encoded audio signal RX into a digital audio signal 34. The speaker interface 18 converts the digital audio signal 34 into the audio signal 30 suitable for driving the loudspeaker 14.

In embodiments of the present invention, where audio access device 7 is a VOIP device, some or all of the components within audio access device 7 are implemented within a handset. In some embodiments, however, microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 7 can be implemented and partitioned in other ways known in the art.

In embodiments of the present invention where audio access device 7 is a cellular or mobile telephone, the elements within audio access device 7 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

The speech processing for improving unvoiced/voiced classification described in various embodiments of the present invention may be implemented in the encoder 22 or the decoder 24, for example. The speech processing for improving unvoiced/voiced classification may be implemented in hardware or software in various embodiments. For example, the encoder 22 or the decoder 24 may be part of a digital signal processing (DSP) chip.

Figure 12:
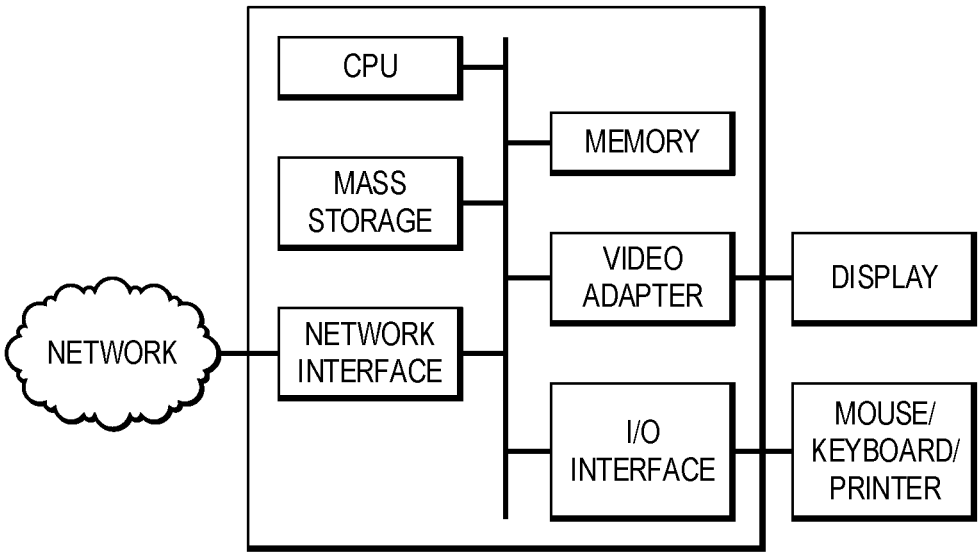
FIG. 12 illustrates a block diagram of a processing system that may be used for implementing the devices and methods disclosed herein.

FIG. 12 illustrates a block diagram of a processing system that may be used for implementing the devices and methods disclosed herein. Specific devices may utilize all of the components shown, or only a subset of the components, and levels of integration may vary from device to device. Furthermore, a device may contain multiple instances of a component, such as multiple processing units, processors, memories, transmitters, receivers, etc. The processing system may comprise a processing unit equipped with one or more input/output devices, such as a speaker, microphone, mouse, touchscreen, keypad, keyboard, printer, display, and the like. The processing unit may include a central processing unit (CPU), memory, a mass storage device, a video adapter, and an I/O interface connected to a bus.

The bus may be one or more of any type of several bus architectures including a memory bus or memory controller, a peripheral bus, video bus, or the like. The CPU may comprise any type of electronic data processor. The memory may comprise any type of system memory such as static random access memory (SRAM), dynamic random access memory (DRAM), synchronous DRAM (SDRAM), read-only memory (ROM), a combination thereof, or the like. In an embodiment, the memory may include ROM for use at boot-up, and DRAM for program and data storage for use while executing programs.

The mass storage device may comprise any type of storage device configured to store data, programs, and other information and to make the data, programs, and other information accessible via the bus. The mass storage device may comprise, for example, one or more of a solid state drive, hard disk drive, a magnetic disk drive, an optical disk drive, or the like.

The video adapter and the I/O interface provide interfaces to couple external input and output devices to the processing unit. As illustrated, examples of input and output devices include the display coupled to the video adapter and the mouse/keyboard/printer coupled to the I/O interface. Other devices may be coupled to the processing unit, and additional or fewer interface cards may be utilized. For example, a serial interface such as Universal Serial Bus (USB) (not shown) may be used to provide an interface for a printer.

The processing unit also includes one or more network interfaces, which may comprise wired links, such as an Ethernet cable or the like, and/or wireless links to access nodes or different networks. The network interface allows the processing unit to communicate with remote units via the networks. For example, the network interface may provide wireless communication via one or more transmitters/transmit antennas and one or more receivers/receive antennas. In an embodiment, the processing unit is coupled to a local-area network or a wide-area network for data processing and communications with remote devices, such as other processing units, the Internet, remote storage facilities, or the like.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. For example, various embodiments described above may be combined with each other.

Although the present invention and its advantages have been described in detail, it should be understood that various changes, substitutions and alterations can be made herein without departing from the spirit and scope of the invention as defined by the appended claims. For example, many of the features and functions discussed above can be implemented in software, hardware, or firmware, or a combination thereof. Moreover, the scope of the present application is not intended to be limited to the particular embodiments of the process, machine, manufacture, composition of matter, means, methods and steps described in the specification.

As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A non-transitory computer-readable storage medium comprising instructions which, when executed by one or more processors, cause the one or more processors to process speech signals prior to encoding a digital signal comprising audio data by carrying out steps comprising:

receiving the digital signal that is to be encoded; and selecting time domain coding based on determining that a coding bit rate to be used for coding the digital signal is less than a first bit rate limit, and detecting that the digital signal comprises a short pitch signal for which the pitch lag is shorter than a pitch lag limit, wherein the pitch lag limit is a minimum allowable pitch for a Code Excited Linear Prediction Technique (CELP) algorithm for coding the digital signal.

2. The non-transitory computer-readable storage medium of claim 1, wherein the minimum allowable pitch is 34 when a sampling rate is 12.8 kHz.

3. The non-transitory computer-readable storage medium of claim 1, wherein the first bit rate limit is 24.4 kbps.

4. The non-transitory computer-readable storage medium of claim 1, wherein the instructions, when executed by the one or more processors, further cause the one or more processors to carry out steps comprising:

selecting frequency domain coding for coding the digital signal based on determining that the coding bit rate is greater than the first bit rate limit.

5. The non-transitory computer-readable storage medium of claim 4, wherein the first bit rate limit is 24.4 kbps.

6. The non-transitory computer-readable storage medium of claim 1, wherein detecting the digital signal comprises a short pitch signal comprises:

detecting the digital signal comprises the short pitch signal based on a parameter for detecting lack of very low frequency energy or a parameter for spectral sharpness.

7. The non-transitory computer-readable storage medium of claim 1, wherein the instructions, when executed by the one or more processors, further cause the one or more processors to carry out steps comprising: coding the digital signal using the selected time domain coding.

8. A device for processing speech signals prior to encoding a digital signal comprising audio data, the device comprising:

a display;

a memory storing computer instructions;

a processor coupled to retrieve and execute the computer instructions to prompt the processor to perform the steps of:

receiving the digital signal that is to be encoded; and selecting time domain coding based on determining that a coding bit rate to be used for coding the digital signal is less than a first bit rate limit, and detecting that the digital signal comprises a short pitch signal for which the pitch lag is shorter than a pitch lag limit, wherein the pitch lag limit is a minimum allowable pitch for a Code Excited Linear Prediction Technique (CELP) algorithm for coding the digital signal.

9. The device of claim 8, wherein the minimum allowable pitch is 34 when a sampling rate is 12.8 kHz.

10. The device of claim 8, wherein the first bit rate limit is 24.4 kbps.

11. The device of claim 8, the processor is further configured to execute the computer instructions to prompt the processor to perform the steps of:

selecting frequency domain coding for coding the digital signal based on:

determining the digital signal comprises the short pitch signal, the coding bit rate is intermediate between the first bit rate limit and a second bit rate limit, and a voicing periodicity is low.

12. The device of claim 11, wherein the first bit rate limit is 24.4 kbps, the second bit rate limit is 46.2 kbps.

13. The device of claim 11, the processor is further configured to execute the computer instructions to prompt the processor to perform the steps of selecting frequency domain coding for coding the digital signal when a coding bit rate is higher than the second bit rate limit.

14. The device of claim 8, wherein detecting the digital signal comprising the short pitch signal comprises:

detecting based on a parameter for detecting lack of very low frequency energy or a parameter for spectral sharpness.

15. The device of claim 8, the processor is further configured to execute the computer instructions to prompt the processor to perform the steps of coding the digital signal using the selected time domain coding.

16. A device for processing speech signals prior to encoding a digital signal comprising audio data, the device comprising:

a display;

a memory storing computer instructions;

a processor coupled to retrieve and execute the computer instructions to prompt the processor to perform the steps of:

receiving the digital signal that is to be encoded;

selecting a coding scheme to be time domain coding in response to determining that a coding bit rate to be used for coding the digital signal is less than a first bit rate limit, and frequency domain coding in response to determining that the coding bit rate is intermediate between the first bit rate limit and a second bit rate limit, and a voicing periodicity is low; and coding the digital signal with the selected coding scheme in response to detecting that the digital signal comprises a short pitch signal for which the pitch lag is shorter than a pitch lag limit, wherein the pitch lag limit is a minimum allowable pitch for a Code Excited Linear Prediction Technique (CELP) algorithm for coding the digital signal.

17. The device of claim 16, wherein the minimum allowable pitch is 34 when a sampling rate is 12.8 kHz.

18. The device of claim 16, wherein the first bit rate limit is 24.4 kbps, the second bit rate limit is 46.2 kbps.

19. The device of claim 16, the processor is further configured to execute the computer instructions to prompt the processor to perform the steps of selecting the coding scheme to be frequency domain coding in response to determining that the coding bit rate is higher than the second bit rate limit.

20. The device of claim 16, wherein detecting the digital signal comprising the short pitch signal comprises:

detecting based on a parameter for detecting lack of very low frequency energy or a parameter for spectral sharpness.

* * * * *